US011124347B2

(12) United States Patent
Chen

(10) Patent No.: US 11,124,347 B2
(45) Date of Patent: Sep. 21, 2021

(54) CASE WITH A CORNER-PROTECTION STRUCTURE BACKGROUND

(71) Applicant: Shou-Te Chen, Taichung (TW)

(72) Inventor: Shou-Te Chen, Taichung (TW)

( * ) Notice: Subject to any disclaimer, the term of this patent is extended or adjusted under 35 U.S.C. 154(b) by 0 days.

(21) Appl. No.: 16/713,037

(22) Filed: Dec. 13, 2019

(65) Prior Publication Data

US 2021/0179334 A1 Jun. 17, 2021

(51) Int. Cl.
*B65D 81/05* (2006.01)

(52) U.S. Cl.
CPC ..... *B65D 81/055* (2013.01)

(58) Field of Classification Search
CPC .... B65D 81/055; B65D 71/04; B65D 81/053; B65D 81/054; B65D 81/056
USPC ..... 206/521.2, 586, 453; 190/18 R, 122, 190/124; 24/305, 350, 907, 371
See application file for complete search history.

(56) References Cited

U.S. PATENT DOCUMENTS 3,025,995 A * 3/1962 Gravlin ..... A45C 13/36 220/639
4,524,494 A * 6/1985 Sato ..... F16B 21/082 174/138 D
4,635,326 A * 1/1987 Yagi ..... F16B 5/0614 174/138 D
6,368,694 B1 * 4/2002 Marsh ..... A47B 95/043 206/453
7,264,863 B2 * 9/2007 Haymond ..... A47B 95/043 206/453
8,376,166 B2 * 2/2013 Kindig ..... B23K 9/1006 220/4.02
8,690,471 B2 * 4/2014 Wians ..... A47F 5/0018 403/231
8,844,719 B2 * 9/2014 Yoshida ..... B65D 81/056 206/453
10,219,595 B2 * 3/2019 Tonelli ..... A45C 13/36
2003/0038054 A1 * 2/2003 Hurley ..... B65D 81/056 206/586
2006/0264076 A1 * 11/2006 Chen ..... H01R 12/585 439/82
2007/0138041 A1 * 6/2007 Welsh ..... B25H 3/02 206/349
2007/0251855 A1 * 11/2007 Curnow ..... A61B 50/33 206/586

(Continued)

*Primary Examiner* — Rafael A Ortiz
(74) *Attorney, Agent, or Firm* — Bruce Stone LLP; Joseph A. Bruce

(57) ABSTRACT

A case with a corner-protection structure includes: the case has at least one assembling portion located at a corner, the assembling portion includes: an outer surface, an inner surface opposite to the outer surface, an assembling hole extending through the outer surface and the inner surface, and two assembling grooves formed in the outer surface and disposed at opposite sides of the assembling portion; and a corner-protection member detachably assembled on the assembling portion of the case, the corner-protection member includes: an abutting surface abutted against the outer surface, two engaging portions disposed on the abutting surface and slidably disposed in the two assembling grooves, and an engaging post disposed on the abutting surface and inserted in the assembling hole. The corner-protection structure is capable of protecting the fragile corners of the case, and effectively reducing the problem that the corners are easily damaged by collision.

3 Claims, 5 Drawing Sheets

(56) References Cited

U.S. PATENT DOCUMENTS

| | | | | |
|---|---|---|---|---|
| 2012/0160733 | A1* | 6/2012 | Liang | G06F 1/1656 206/586 |
| 2013/0032506 | A1* | 2/2013 | Grenchus, Jr. | B65D 81/056 206/586 |

* cited by examiner

CASE WITH A CORNER-PROTECTION STRUCTURE BACKGROUND

BACKGROUND

Field of the Invention

The present invention relates to a corner-protection structure, and more particularly to a case with a corner-protection structure.

Related Prior Art

Please refer to FIG. 1, generally, a case 10, such as a trunk, a tool box, etc., often inadvertently collides on the way of transportation, causing problems such as concave folding, abrasion, toppling over, etc. In particular, the corners 11 of the case 10 are more likely to be deformed or cracked by collision, etc., which may damage the structure of the case 10 itself or hurt the user.

In addition, the conventional case 10 is integrally formed, so that it is structurally incapable of additionally protecting the corners 11 of the case 10, and the protection to the corners 11 of the case 10 is relatively weak. The case 10 might be damaged when unexpectedly colliding with other objects, so that the durability of the case 10 is insufficient and the service life is reduced.

Furthermore, since the conventional case 10 is integrally formed, if the corners 11 of the case 10 are damaged, they cannot be replaced independently, and the entire case 10 has to be discarded, which is a waste of resources, and is not economical, and also causes a burden on the consumer.

The present invention has arisen to mitigate and/or obviate the afore-described disadvantages.

SUMMARY

One objective of the present invention is to provide a case with a corner-protection structure, which is capable of protecting the fragile corners of the case, and effectively reducing the problem that the corners of the case are damaged by collision.

To achieve the above objective, a case with a corner-protection structure provided by the present invention comprises:

the case has at least one assembling portion located at a corner, the assembling portion includes: an outer surface, an inner surface opposite to the outer surface, an assembling hole extending through the outer surface and the inner surface, and two assembling grooves formed in the outer surface and disposed at opposite sides of the assembling portion; and a corner-protection member detachably assembled on the assembling portion of the case, wherein the corner-protection member includes: an abutting surface abutted against the outer surface, two engaging portions disposed on the abutting surface and slidably disposed in the two assembling grooves, and an engaging post disposed on the abutting surface and inserted in the assembling hole.

Preferably, the engaging post has a head portion that abuts against the inner surface of the assembling portion, and a body portion connected to the head portion and inserted through the assembling hole, the head portion of the engaging post is provided with two elastic segments which are elastic and spaced apart from each other, and the two elastic segments are capable of being pressed under the action of an external force to pass through the assembling hole.

Preferably, each of the assembling grooves has an arc bevel, and each of the engaging portions is Y-shaped and has two inclined surfaces respectively disposed at opposite sides thereof and abutting against the arc bevel.

Preferably, the case is a trunk, a storage box, or a tool box.

Preferably, the corner-protection member is a polyhedron. These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION

Figure 1:
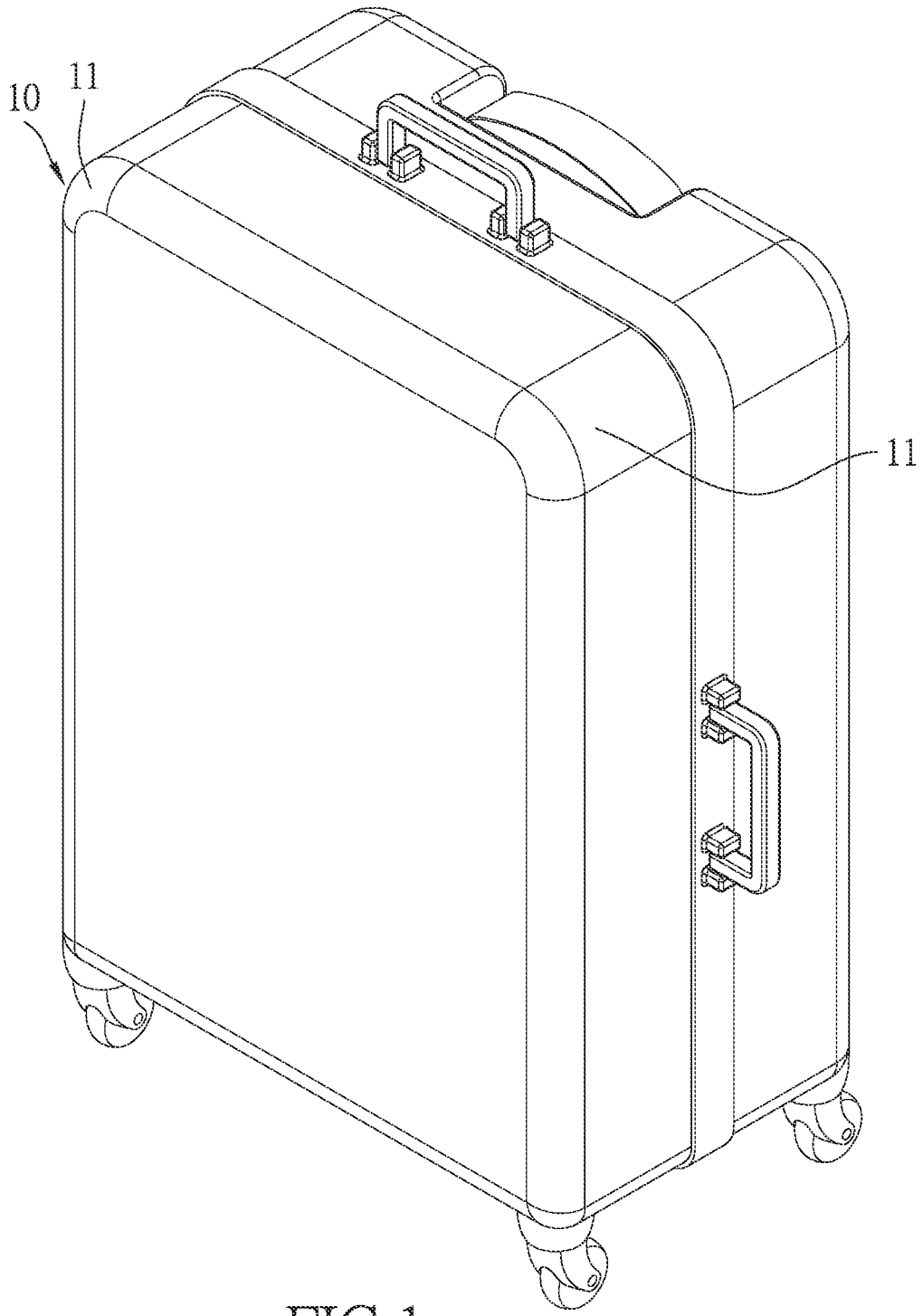
FIG.1 PRIOR ART
FIG. 1 is the structure view of a conventional case.
Figure 2:
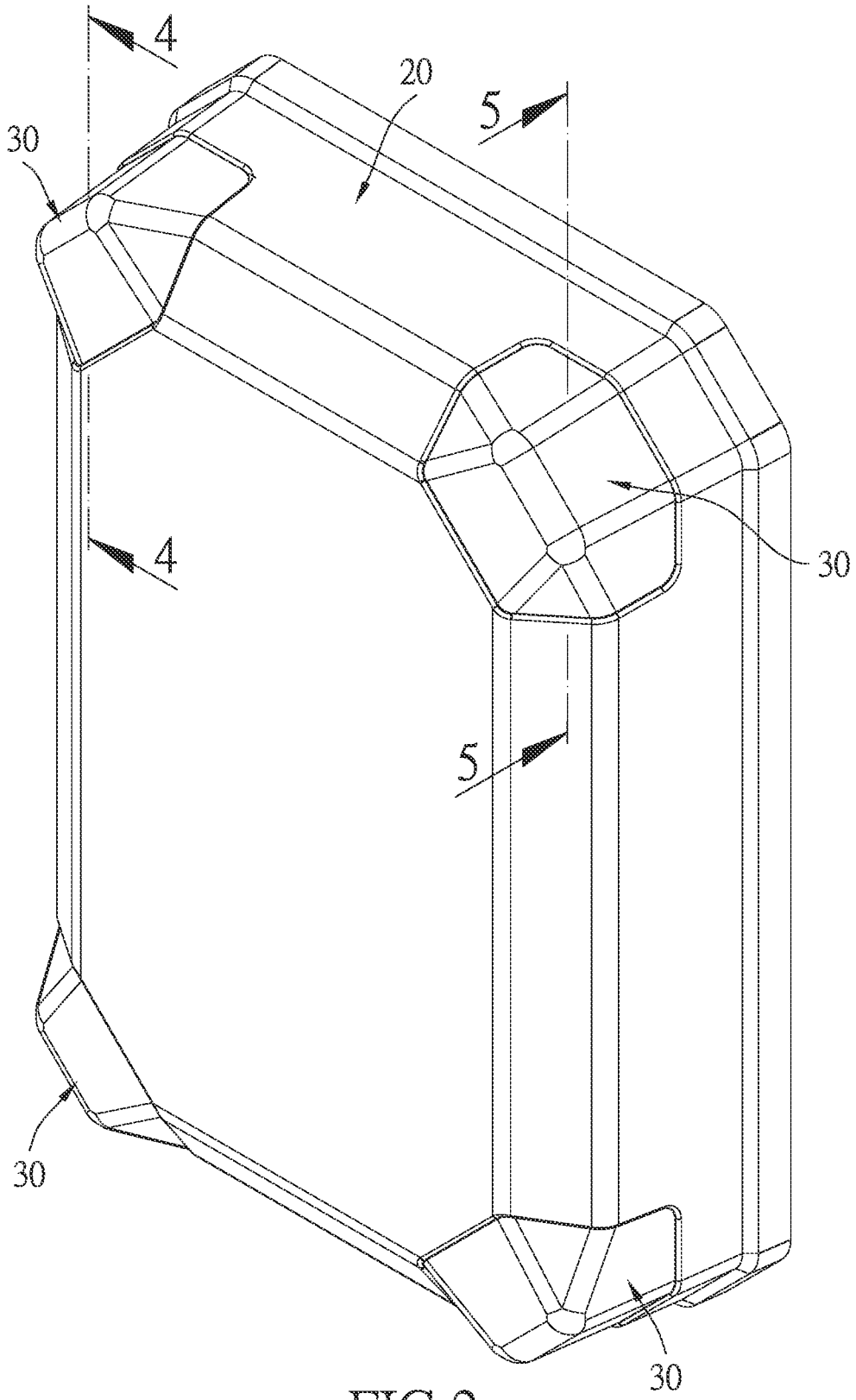
FIG. 2 is a perspective assembled view of an embodiment of the present invention.
Figure 3:
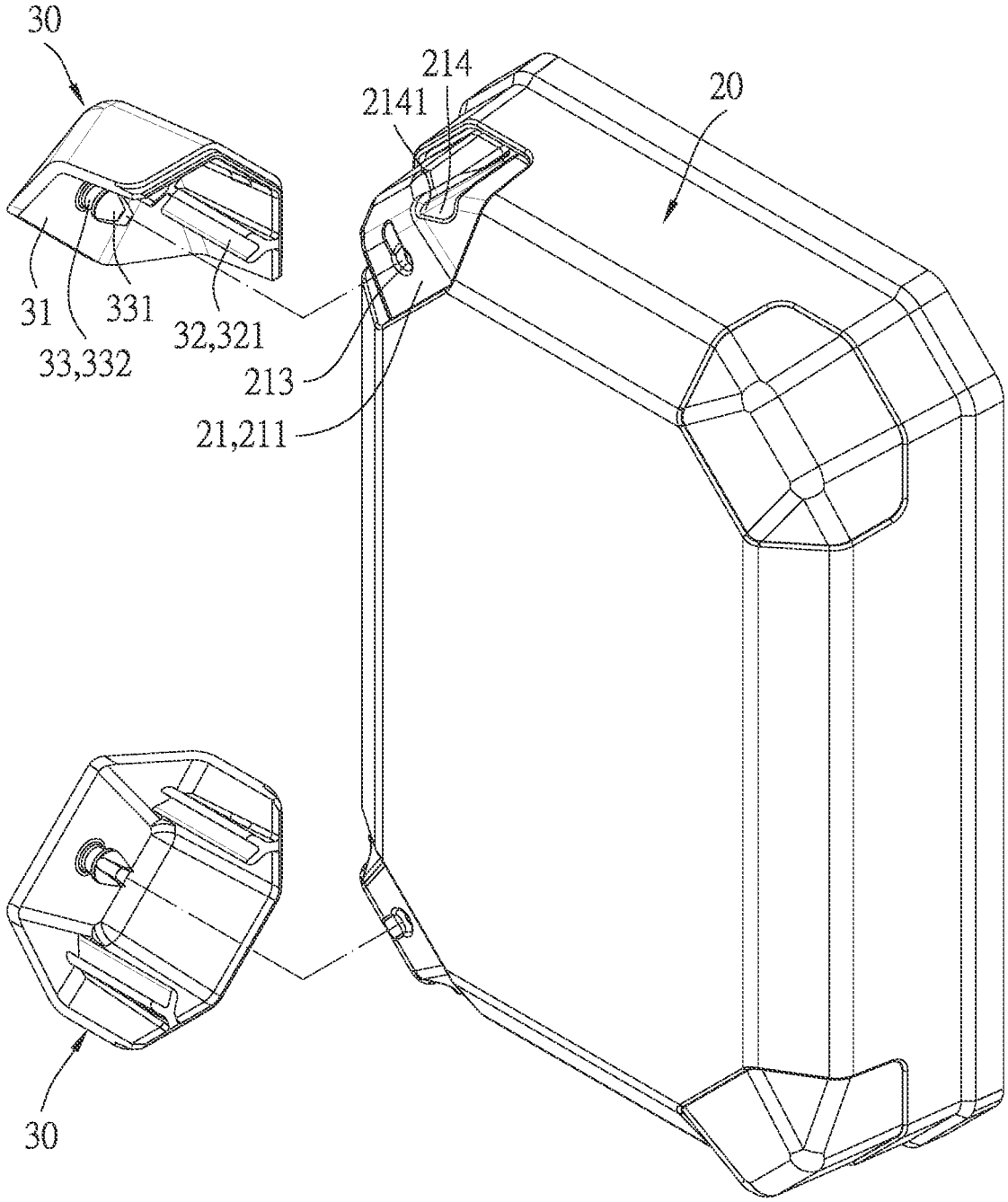
FIG. 3 is an exploded perspective view of the embodiment of the present invention.

The present invention will be clearer from the following description when viewed together with the accompanying drawings, which show, for purpose of illustrations only, the preferred embodiment in accordance with the present invention.

Referring to FIGS. 2-5, a case with a corner-protection structure in accordance with a preferred embodiment of the present invention essentially comprises: a case 20 and four corner-protection members 30. The case 20 is a luggage trunk for example, but is not limited thereto, can also be a box having corners, such as a storage box or tool box.

The case 20 has four assembling portions 21 respectively located at four corners, and each of the assembling portions 21 includes: an outer surface 211, an inner surface 212 opposite to the outer surface 211, an assembling hole 213 extending through the outer surface 211 and the inner surface 212, and two assembling grooves 214 formed in the outer surface 211 and disposed at opposite sides of the assembling portion 21. In this embodiment, each of the assembling grooves 214 has an arc bevel 2141.

The four corner-protection members 30 are detachably assembled on the four assembling portions 21 of the case 20, and each of the corner-protection members 30 includes: an abutting surface 31 abutted against the outer surface 211, two engaging portions 32 disposed on the abutting surface 31 and slidably disposed in the two assembling grooves 214, and an engaging post 33 disposed on the abutting surface 31, inserted in the assembling hole 213, and located between the two engaging portions 32. In this embodiment, each of the corner-protection members 30 is a polyhedron, and the design can improve the safety of use. If the user inadvertently hits the corner-protection member 30, the polyhedron structure of the corner-protection member 30 can protect the user from injury, and can further enhance the overall impact bearing strength of the case 20, thereby improving durability.

In addition, each of the corner-protection members 30 is detachably assembled to the assembling portions 21 of the case 20. When one of the corner-protection members 30 is damaged, it is only necessary to replace the damaged corner-protection member 30, without discarding the entire case 20, thereby achieving the purpose of long-term use and reducing the economic burden of use.

Figure 4:
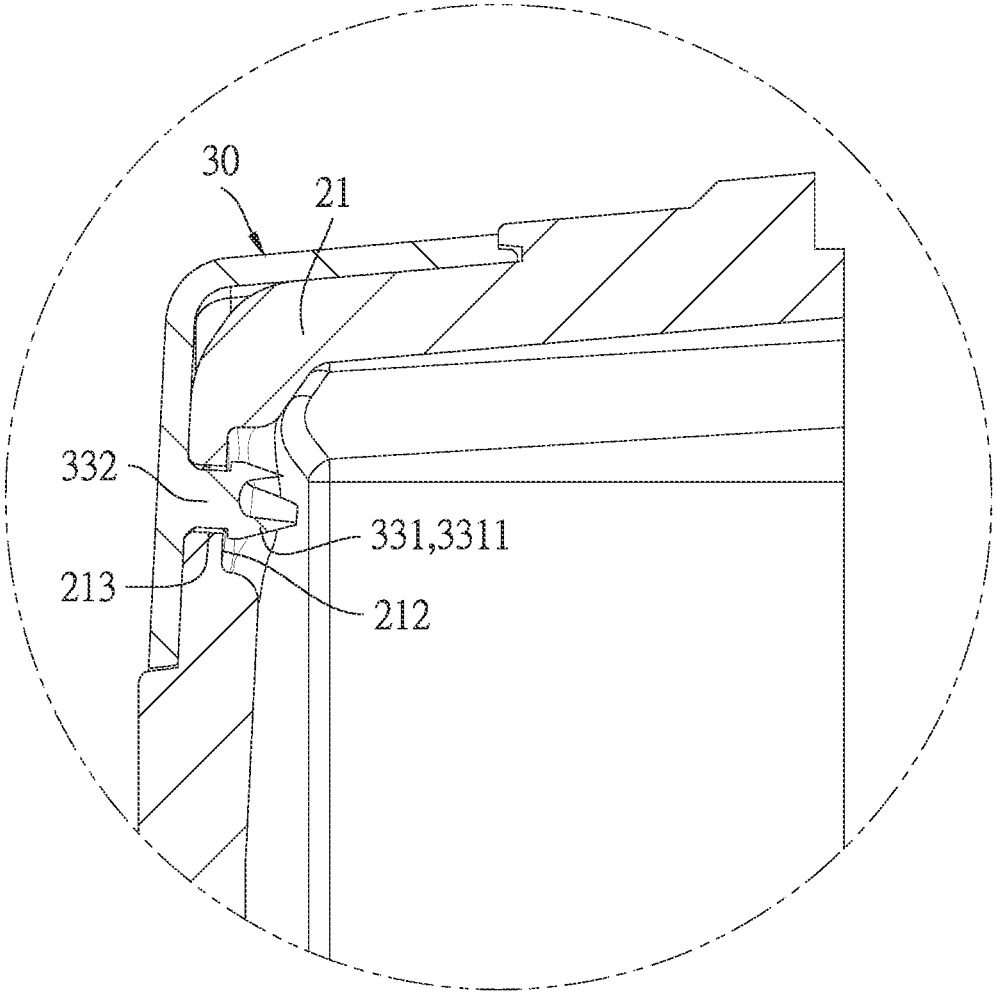
FIG. 4 is an enlarged cross-sectional view taken along the line 4-4 of FIG. 2.

Referring to FIG. 4, the engaging post 33 of each corner-protection member 30 has a head portion 331 that abuts against the inner surface 212 of the assembling portions 21, and a body portion 332 connected to the head portion 331 and inserted through the assembling hole 213. The head portion 331 of the engaging post 33 is provided with two elastic segments 3311 which are elastic and spaced apart from each other. The two elastic segments 3311 can be pressed under the action of an external force to pass through the assembling hole 213. After the head portion 331 of the engaging post 33 passes through the assembling hole 213, the two elastic segments 3311 of the head portion 331 return to a normal state, so that the head portion 331 of the engaging post 33 is positioned against the inner surface 212 of the assembling portion 21 to finish the assembling operation. When the corner-protection member 30 is to be removed, the user can press the two elastic segments 3311 from the inner side of the case 20 to press the two elastic segments 3311 to complete the disassembly operation.

Figure 5:
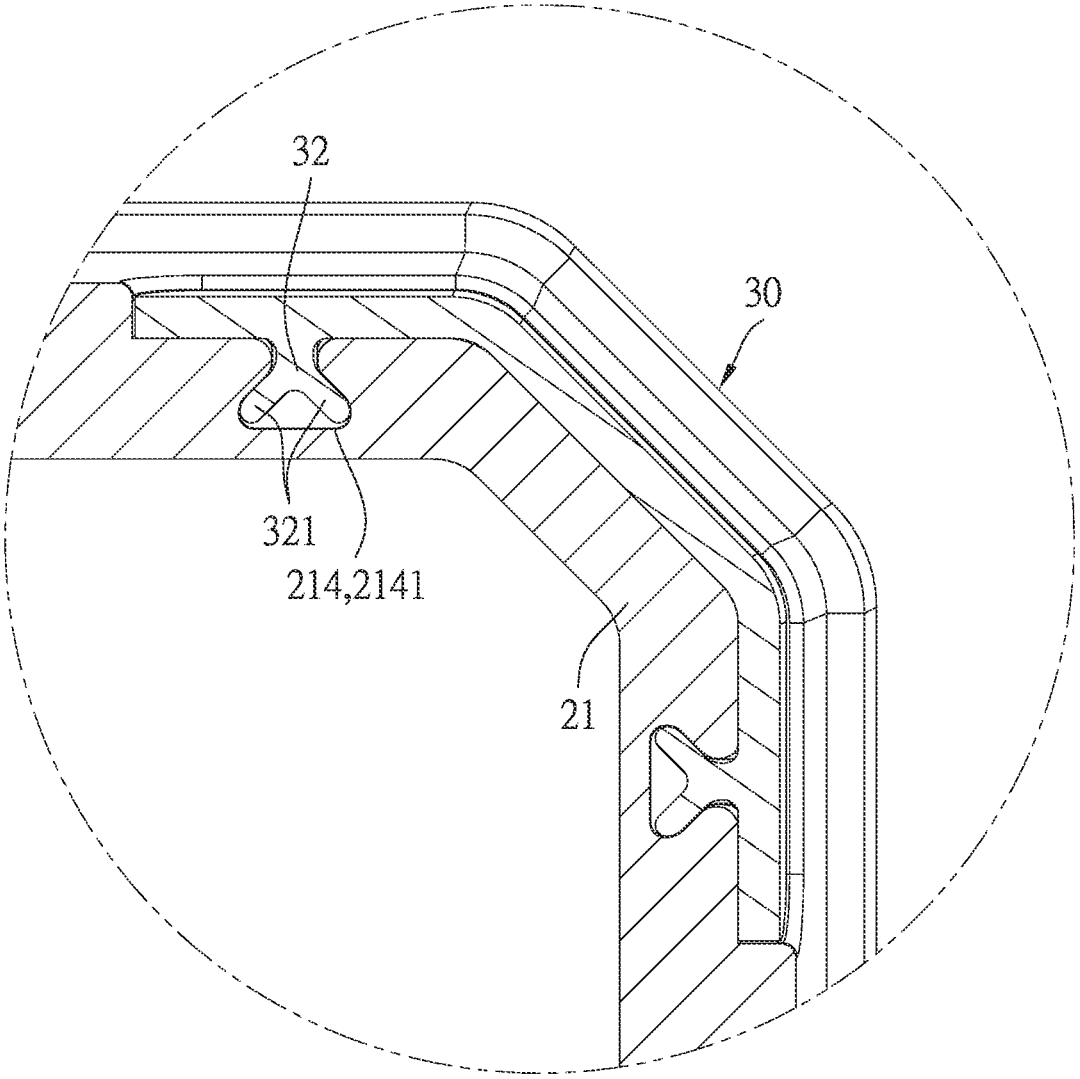
FIG. 5 is an enlarged cross-sectional view taken along the line 5-5 of FIG. 2.

Referring to FIG. 5, each of the engaging portions 32 is Y-shaped and has two inclined surfaces 321 respectively disposed at opposite sides thereof and abutting against the arc bevel 2141, thus achieving the abovementioned slide positioning for facilitating assembling and disassembly.

What mentioned above are the structural relations of the main components of the embodiments, and the operation and function of the invention are explained as follows:

Thereby, the present invention provides a case with a corner-protection structure, which is characterized in that a corner-protection member 30 is detachably disposed at each of the four corners of the case 20 to protect the corners of the case 20 from being deformed by impact, thereby achieving the purpose of protecting the corners of the case 20 and extending the service life of the case 20.

In addition, the four corner-protection members 30 can also increase the overall aesthetic appearance of the case 20, thereby increasing the consumer's desire to purchase and the market share.

While we have shown and described various embodiments in accordance with the present invention, it is clear to those skilled in the art that further embodiments may be made without departing from the scope of the present invention.

What is claimed is:

1. A case with a corner-protection structure, comprising:

the case having at least one assembling portion located at a corner, each of the assembling portions including: an outer surface, an inner surface opposite to the outer surface, an assembling hole extending through the outer surface and the inner surface, and two assembling grooves formed in the outer surface and disposed at opposite sides of the assembling portion; and a corner-protection member detachably assembled on the assembling portion of the case, wherein the corner-protection member includes: an abutting surface abutted against the outer surface, two engaging portions disposed on the abutting surface and slidably disposed in the two assembling grooves, and an engaging post disposed on the abutting surface and inserted in the assembling hole, wherein the corner-protection member is a polyhedron;

wherein each of the assembling grooves has an arc bevel, and each of the engaging portions is Y-shaped and has two inclined surfaces respectively disposed at opposite sides thereof and abutting against the arc bevel.

2. The case with the corner-protection structure as claimed in claim 1, wherein the engaging post has a head portion that abuts against the inner surface of the assembling portion, and a body portion connected to the head portion and inserted through the assembling hole, the head portion of the engaging post is provided with two elastic segments which are elastic and spaced apart from each other, and the two elastic segments are capable of being pressed under the action of an external force to pass through the assembling hole.

3. The case with the corner-protection structure as claimed in claim 1, wherein the case is a trunk, a storage box, or a tool box.

* * * * *